United States Patent [19]

Lind et al.

[11] 4,243,646

[45] Jan. 6, 1981

[54] TREATMENT OF CARBON FIBRE

[75] Inventors: David J. Lind, Breadsall; Valerie J. Coffey, Long Eaton; Joyce Hallam, Milford, all of England

[73] Assignee: Rolls-Royce Limited, London, England

[21] Appl. No.: 948,293

[22] Filed: Aug. 29, 1978

[30] Foreign Application Priority Data

Oct. 4, 1977 [GB] United Kingdom ..... 41140/77

[51] Int. Cl.[3] ..... D01F 9/12

[52] U.S. Cl. ..... 423/447.1; 106/307; 423/447.2

[58] Field of Search ..... 423/447.1, 447.2, 447.4, 423/447.6; 106/307; 427/227, 314

[56] References Cited

U.S. PATENT DOCUMENTS

| | | | |
|---|---|---|---|
| 3,476,703 | 11/1969 | Wadsworth et al. | 423/447.2 X |
| 3,720,536 | 3/1973 | Scola et al. | 423/447.1 |
| 3,964,952 | 6/1976 | Brie et al. | 423/447.1 |
| 4,009,305 | 2/1977 | Fujimaki et al. | 423/460 X |
| 4,073,869 | 2/1978 | Kalnin | 423/447.1 |

FOREIGN PATENT DOCUMENTS

| | | | |
|---|---|---|---|
| 1124807 | 12/1970 | United Kingdom | 423/447.2 |

*Primary Examiner*—Edward J. Meros

*Attorney, Agent, or Firm*—Cushman, Darby & Cushman

[57] ABSTRACT

A method of treating carbon fibre in which the fibre is subjected to a surface removal step followed by a surface deactivation step. The surface deactivation step comprises either removing at least some of the functional groups on the surface of the fibre or rendering those functional groups incapable of forming a chemical bond with a resin matrix material. When such treated fibres are incorporated in a resin matrix, the resultant composite material is provided with enhanced strength properties when compared with similar composite materials containing untreated carbon fibres.

2 Claims, No Drawings

TREATMENT OF CARBON FIBRE

BACKGROUND OF THE INVENTION

This invention relates to the treatment of carbon fibre and in particular to a method of treating the surface of carbon fibre.

Carbon fibre is conventionally produced by subjecting an organic polymer fibre to various conditions of temperature and atmosphere. Thus, for example, polyacrylonitrile fibre may be heated at a temperature in the range 200 to 300° C. in an oxidising atmosphere and subsequently heated at a temperature of at least 1000° C. in an inert atmosphere to give carbon fibre.

Carbon fibre which is so produced is characterised by high breaking strain and Youngs modulus. Indeed such fibres are commonly incorporated in a resin matrix to provide a composite material having both strength and lightness.

In order to increase the strength of carbon fibre, it is known, for instance from British Pat. No. 1,214,807, to subject the fibre to a surface removal step whereby the surface layer of the fibre is removed together with any flaws therein. Such surface removal may be achieved by various alternative methods such as ion bombardment oxidation and surface dissolution.

Whilst such treated carbon fibre is stronger than untreated carbon fibre, it has been reported (K. Morita, H. Miyachi, K. Kobori and I. Matsubara International Carbon Conference, Baden-Baden 1976) that when the treated fibre is incorporated in a resin matrix the resulting composite material is inferior to similar composite materials produced from untreated fibre. In particular, composite materials produced from the treated fibre tend to be more brittle than those produced from untreated fibre. Generally, therefore, it is apparent that the superior strength characteristics of the treated carbon fibre are not being transferred to the composite material in which they are incorporated.

DETAILED DESCRIPTION OF THE INVENTION

It is an object of the present invention to provide a method of treating carbon fibre which has been subjected to a surface removal step whereby the enhanced strength of such carbon fibre is more effectively utilised when such fibre is incorporated in a resin matrix.

According to the present invention a method of treating carbon fibre comprises subjecting the fibre to a surface removal step in which the surface layer of the fibre is removed together with any flaws therein and subsequently subjecting the fibre to a surface deactivation step in which at least some of the functional groups on the surface of said fibre are either removed or rendered incapable of forming a chemical bond with a resin matrix material.

We believe that after carbon fibre has been subjected to a surface removal step, and subsequently incorporated in a resin matrix, at least some functional groups remaining on the fibre surface form what appears to be a chemical bond with the resin. This results in a strong fibre/resin bond which is reflected in the brittle nature of the thus formed composite material. By subjecting the carbon fibre to a surface deactivation step, the tendency for such chemical bonding to occur is substantially reduced and consequently the strength of the fibre/resin bond is correspondingly reduced. This, we have found, results in a composite material having enhanced strength characteristics when compared with composite materials formed from fibre which has been subjected to a surface removal step but which has not been subjected to a surface deactivation step.

Deactivation of the fibre surface may be achieved in two ways; either at least some of the functional groups may be removed or they may be rendered incapable of forming a chemical bond with a resin matrix material. In the former case we prefer to remove at least some of the funcational groups by heating the fibre in an inert atmosphere. Thus for instance the fibre may be heated in an atmosphere of nitrogen at a temperature of 530° C. In the latter case, the functional groups may be prevented from reacting with a resin matrix by providing the fibre with a coating of a material which does not form any chemical bond with either the fibre or the resin matrix. One such suitable material is polyethylene.

The method of the present invention is illustrated by the following examples:

EXAMPLE 1

A 220 meter length tow of 3000 filament high strain carbon fibre obtained from Toray Industries was wound on to a stainless steel frame. The frame was then placed in a bath containing concentrated nitric acid (SG 1.42 g/ml) at a temperature of 80° C. After being agitated for a period of nine hours, the nitric acid was allowed to cool to room temperature whereupon the frame was removed and the carbon fibre sequentially washed in water, 1:3 v/v 0.88 ammonium hydroxide/water mixture, water and finally acetone before being dried at 80° C.

A number of individual fibres were then separated from the tow and their breaking strain determined using a fibre gauge length of 23 mm i.e. the length of free fibre between its points of attachment to the breaking strain determining apparatus was 23 mm. A sample of similar carbon fibre which had not been subjected to the nitric acid treatment was similarly tested. The results were as follows:

| Fibre | Breaking Strain |
|---|---|
| As received | 1.52% |
| After nitric acid treatment | 1.81% |

Thus, as expected, the removal of the surface layer from the carbon fibre by the nitric acid resulted in an increase in fibre breaking strain.

A length of tow of the nitric acid treated fibre was then divided into two portions designated Sample 1 and Sample 2. Sample 1 was then pulled through a bath containing a 2% w/v solution of polyethylene (molecular weight 2000) in xylene. After removal from the bath, the tow was dried at a temperature of 125° C. to leave each fibre with a polyethylene coating. The two was then pulled through a bath containing 100 parts by weight of Ciba Geigy CY 179 epoxy resin and 1¼ parts by weight of Ciba Geigy HG 973 $BF_3$.MEA hardener. The resin impregnated tow was then removed from the bath and cured by heating in tension at a temperature of 130° C. for ½ hour.

Sample 2 which had not been pulled through the polyethylene solution was similarly impregnated with the above epoxy resin/hardener mixture.

The two resin impregnated tows were then tested on an Instron tensile testing machine using in each case a gauge length of 200 mm of impregnated tow. The results were as follows:

| Tow | Load to Failure | Fibre Breaking Stress |
|---|---|---|
| Sample 1 | 25.8 Kg | 2.26 GN/m$^2$ |
| Sample 2 | 20.1 Kg | 1.76 GN/m$^2$ |

Thus it will be seen that the fibre tow which had not been subjected to the polyethylene coating step was inferior in both load to failure and fibre breaking stress to the fibre tow which had been so coated.

EXAMPLE 2

A tow of high strain carbon fibre similar to that used in Example 1 was subjected to the same nitric acid treatment described in Example 1.

The tow was then divided into two portions; designed Sample 3 and Sample 4. Sample 3 was passed through a furnace heated at a temperature of 530° C. and containing an atmosphere of nitrogen. Both portions were then impregnated with an epoxy resin/hardener mixture as described in Example 1 and similarly tested on the Instron tensile testing machine. The results were as follows:

| Tow | Load to Failure | Fibre Breaking Stress |
|---|---|---|
| Sample 3 | 34.6 Kg | 3.03 GN/m$^2$ |

-continued

| Tow | Load to Failure | Fibre Breaking Stress |
|---|---|---|
| Sample 4 | 26.2 Kg | 2.26 GN/m$^2$ |

Thus the fibre tow which had not been subjected to the heating step in nitrogen was inferior in both load to failure and fibre breaking stress to the fibre tow which had been subjected to the heating step in nitrogen.

We claim:

1. A method of treating carbon fibre to enhance the strength thereof when incorporated in a resin matrix, said method consisting essentially of:
   (1) subjecting the fibre to a surface removal step in which the surface layer of the fibre is removed together with any flaws therein, and subsequently
   (2) subjecting the fibre to a surface deactivation step in which at least some of the functional groups on the surface of said fibre are either removed or rendered incapable of forming a chemical bond with the resin matrix material by heating said fibre in an inert atmosphere of nitrogen.

2. A method of treating carbon fiber to enhance the strength thereof when incorporated in a resin matrix, said method comprising:
   (1) subjecting the fiber to a surface removal step in which the surface layer of the fiber is removed together with any flaws therein, and subsequently
   (2) subjecting the fiber to a surface deactivation step in which at least some of the functional groups on the surface of said fiber are either removed or rendered incapable of forming a chemical bond with the resin matrix material by heating said fiber in an inert atmosphere of nitrogen at a temperature of 530° C.

* * * * *